US009236700B2

(12) United States Patent
Okumura

(10) Patent No.: US 9,236,700 B2
(45) Date of Patent: Jan. 12, 2016

(54) METHOD FOR PRODUCING GLOW PLUG TERMINALS, AND METHOD FOR PRODUCING GLOW PLUGS

(75) Inventor: Yuki Okumura, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 185 days.

(21) Appl. No.: 13/876,191

(22) PCT Filed: Aug. 17, 2011

(86) PCT No.: PCT/JP2011/068628

§ 371 (c)(1), (2), (4) Date: Mar. 27, 2013

(87) PCT Pub. No.: WO2012/046510

PCT Pub. Date: Apr. 12, 2012

(65) Prior Publication Data

US 2013/0199037 A1 Aug. 8, 2013

(30) Foreign Application Priority Data

Oct. 5, 2010 (JP) ..... 2010-225595
Oct. 5, 2010 (JP) ..... 2010-225599

(51) Int. Cl.

| | |
|---|---|
| ***H01R 43/16*** | (2006.01) |
| ***H05B 3/08*** | (2006.01) |
| ***F23Q 7/22*** | (2006.01) |
| ***H01R 43/00*** | (2006.01) |
| ***F23Q 7/00*** | (2006.01) |
| ***H01R 13/04*** | (2006.01) |

(52) U.S. Cl.

CPC ..... *H01R 43/00* (2013.01); *F23Q 7/001* (2013.01); *F23Q 7/22* (2013.01); *H01R 13/04* (2013.01); *Y10T 29/49204* (2015.01)

(58) Field of Classification Search

CPC .... Y10T 29/49204; H01R 43/16; H05B 3/06; F23Q 7/001

USPC ..... 29/874; 219/541, 270

See application file for complete search history.

(56) References Cited

U.S. PATENT DOCUMENTS

| | | | | |
|---|---|---|---|---|
| 4,312,120 | A * | 1/1982 | Comer | 29/611 |
| 4,491,112 | A * | 1/1985 | Kanegae et al. | 123/479 |
| 4,563,568 | A * | 1/1986 | Takizawa | 219/270 |
| 4,806,734 | A * | 2/1989 | Masaka et al. | 219/270 |
| 4,874,923 | A * | 10/1989 | Hatanaka et al. | 219/270 |
| 4,912,305 | A * | 3/1990 | Tatemasu et al. | 219/544 |

(Continued)

FOREIGN PATENT DOCUMENTS

| | | | |
|---|---|---|---|
| JP | 2002-260827 | 9/2002 | H05B 3/02 |
| JP | 2005-308295 | 11/2005 | F23Q 7/00 |
| JP | 2009-041837 | 2/2009 | F23Q 7/00 |

OTHER PUBLICATIONS

Form PCT/ISA/210—Int'l Search Report (from corresponding Int'l Patent App. No. PCT/JP2011/068628—1 page.

*Primary Examiner* — David Angwin

(74) *Attorney, Agent, or Firm* — Kusner & Jaffe

(57) ABSTRACT

A method of producing a glow plug, wherein a pin terminal is produced by applying a plastic working to a workpiece made of a conductive metal. The production method has: a first step of obtaining a first workpiece; a second step of setting the first workpiece to a second workpiece; a third step of setting the second workpiece to a third workpiece; and a fourth step of setting the third workpiece to a fourth workpiece.

10 Claims, 11 Drawing Sheets

(56) References Cited

U.S. PATENT DOCUMENTS

| | | | | |
|---|---|---|---|---|
| 4,914,751 | A * | 4/1990 | Masaka et al. | 219/270 |
| 5,206,484 | A * | 4/1993 | Issartel | 219/270 |
| 5,218,183 | A * | 6/1993 | Kimata | 219/270 |
| 6,276,325 | B1 * | 8/2001 | Arlton | 123/145 A |
| 6,437,492 | B1 * | 8/2002 | Geissinger et al. | 313/118 |
| 6,531,102 | B1 * | 3/2003 | Nakamura et al. | 422/198 |
| 7,225,778 | B2 * | 6/2007 | Reissner et al. | 123/145 A |
| 2002/0162834 | A1 * | 11/2002 | Asano et al. | 219/541 |
| 2002/0175157 | A1 * | 11/2002 | Terada et al. | 219/270 |
| 2002/0195443 | A1 * | 12/2002 | Tanaka et al. | 219/541 |
| 2003/0029857 | A1 * | 2/2003 | Taniguchi et al. | 219/270 |
| 2007/0151096 | A1 * | 7/2007 | Walker et al. | 29/611 |
| 2013/0180975 | A1 * | 7/2013 | Okumura | 219/270 |

* cited by examiner

METHOD FOR PRODUCING GLOW PLUG TERMINALS, AND METHOD FOR PRODUCING GLOW PLUGS

FIELD OF THE INVENTION

The present invention relates to a method of producing a pin terminal for a glow plug, and a method of producing a glow plug.

BACKGROUND OF THE INVENTION

JP-A-2002-260827 discloses a conventionally known glow plug. As shown in FIG. 11 of the aforementioned Japanese Patent document, the glow plug includes: a cylindrical housing 90; a heater 91 which is fixed into the housing 90, and which has a heating portion 91*a* projecting from the tip end of the housing 90; a rod-like inner shaft 92 which is placed in the housing 90, and in which a rear end portion projects from the rear end of the housing 90; and a pin terminal 93 which is fitted to the rear end portion of the inner shaft 92, and which is used for supplying electricity from the outside to the heating portion 91*a* through the inner shaft 92.

The heater 91 is a ceramic heater which is fitted into an outer sleeve 94 that is fitted to the tip end side of the housing 90, and that is made of a conductive metal, and which allows the heating portion 91*a* to project from the tip ends of the housing 90 and the outer sleeve 94.

The ceramic heater 91 is configured by a rod-like insulating member 80 containing $Si_3N_4$ as a major component. A U-shaped heating member 81 is embedded in the tip end side of the insulating member 80, and contains WC as a major component. A first lead wire 82 has one end connected to one end of the heating member 81, and the other end exposed from a part of the outer circumferential surface of the insulating member 80. A second lead wire 83 has one end connected to the other end of the heating member 81, and the other end exposed from another part of the outer circumferential surface of the insulating member 80. The other end of the first lead wire 82 is connected to the outer sleeve 94, that the other end of the second lead wire 83 is connected to an electric coil 95, and the electric coil 95 is connected to the inner shaft 92. The tip end side of the insulating member 80, in which the heating member 81 is embedded, functions as a heating portion 91*a* of the ceramic heater 91.

The pin terminal 93 has a small-diameter portion 93*a* in the rear end side, and a large-diameter portion 93*b* in the tip end side. The end surface on the rear end side of the small-diameter portion 93*a* has a curved surface shape. A first flange 93*c*, which abuts against an insulator 96 that is disposed on the rear end side of the housing 90 and that is made of an insulating material, is formed on the tip end side of the large-diameter portion 93*b*. A second flange 93*d* is formed on the rear end side of the large-diameter portion 93*b*. An engagement portion 93*e*, that engages an engagement convex portion 85*a* of a cap 97 to which electricity is supplied from the outside, is formed between the first flange 93*c* and the second flange 93*d*.

In the glow plug, the heating portion 91*a* of the ceramic heater 91 is located in a combustion chamber of a diesel engine by screwing a male thread 90*a* of the housing 90 to a cylinder head of the diesel engine. Then, the housing 90 is grounded to the cylinder head, and the cap 97 which leads to a battery, is fitted to the pin terminal 93. The cap 97 is configured by a cup-shaped cap body 85, and an electric conductive member 87 which is fixed, for example, in a state where the electric conductive member extends from the inner side toward the opening side, by a fixing member 86 that is disposed in the inner side of the cap body 85. An engagement convex portion 85*a* which inwardly projects is formed in the opening side of the cap body 85. The electric conductive member 87 is connected to a lead wire 88 which leads to the battery.

When the cap 97 is fitted to the pin terminal 93, the engagement convex portion 85*a* of the cap body 85 overrides the second flange 93*d* to be engaged with the engagement portion 93*e*. In the state, the electric conductive member 87 abuts against the surface of the small-diameter portion 93*a*.

In the ceramic heater 91, therefore, a voltage is applied between: the housing 90, the outer sleeve 94, and the first lead wire 82; and the pin terminal 93, the inner shaft 92, the electric coil 95, and the second lead wire 83, and heating portion 91*a* generates heat by means of the heating member 81. Therefore, starting of the diesel engine is initiated.

According to the publication, a glow plug of this kind is produced in the following manner. Namely, the housing 90, the ceramic heater 91, the inner shaft 92, and the like are first produced. Furthermore, the pin terminal 93 is produced by applying a cutting process to a workpiece made of steel. While required places of these components are electrically connected to one another, then, these components are assembled together, and a glow plug is completed.

In the method of producing a glow plug, however, the pin terminal is produced only by the cutting process performed on the workpiece. Therefore, swarf is excessively wasted, the time period required for production is long, and mass production is difficult. In the conventional production method, therefore, reduction of the production cost of a pin terminal is difficult. Accordingly, also reduction of the production cost of a glow plug is difficult.

The applicant of the present application has filed a patent application related to a method of producing a pin terminal for a glow plug, and method of producing a glow plug which can solve the problems, and obtained a patent on the production methods (Japanese Patent No. 4,241,489). In the production methods, small- and large-diameter portions, first and second flanges, and engagement portion of a pin terminal are formed by a plastic working on a workpiece.

According to the production methods, as compared with the case where a pin terminal is produced only by applying a cutting process to a workpiece, swarf is reduced, and the time period required for production can be shortened. Therefore, mass production is facilitated. According to the production methods, therefore, reduction of the production cost of a pin terminal is realized, and consequently reduction of the production cost of a glow plug is realized.

Also in the production methods, however, the first flange is formed in the tip end of the large-diameter portion, and the second flange is formed in the rear end side of the large-diameter portion in a similar manner as the pin terminal 93 of FIG. 11. In the pin terminal, therefore, a to-be-crimped portion which is formed to have the even outer diameter, and which is capable of being crimped is limited between the first flange and the second flange, and becomes short. In the short to-be-crimped portion, therefore, the inner shaft and the pin terminal are unlikely to be firmly coupled together. Therefore, the coupling strength between them must be ensured by employing a longish inner shaft. In the pin terminal, therefore, reduction of the material has not been sufficient, and also reduction of the weight has not been sufficient. Also in a glow plug, since such a pin terminal is employed, and a longish inner shaft is employed, reduction of the material has not been sufficient, and also reduction of the weight has not been sufficient.

The invention has been conducted in view of the above-discussed circumstances. It is a problem to be solved to enable a high-quality and light-weight pin terminal for a glow plug, and consequently a high-quality and light-weight glow plug to be economically produced.

In accordance with the present invention, there is provided a method of producing a pin terminal for a glow plug, the method comprising:

obtaining a first workpiece which has a rod-like shape, and which is made of the conductive metal;

plastically deforming an end surface of a rear end side of the first workpiece into a curved surface shape to obtain a second workpiece;

plastically deforming a rear end side of the second workpiece into a small-diameter portion which is configured to be fitted to a cap for supplying electricity from an outside, and plastically deforming a tip end side of the second workpiece into a large-diameter portion which is larger in diameter than the small-diameter portion to obtain a third workpiece; and plastically deforming a flange between the small-diameter portion and the large-diameter portion, the flange being larger in outer diameter than the large-diameter portion, and an engagement portion formed between a position where a diameter of the flange is maximum and the large-diameter portion, an outer diameter of the engagement portion being gradually reduced toward the large-diameter portion, and the engagement portion being configured to be engaged with the cap to obtain a fourth workpiece.

Also in the production method of the invention, the small-diameter portion, large-diameter portion, flange, and engagement portion of the pin terminal are formed by applying a plastic working to a workpiece in a similar manner as the above-described production method of Japanese Patent No. 4,241,489 issued to the applicant.

In the production method, moreover, the fourth workpiece which has the flange between the small-diameter portion and the large-diameter portion, and which does not have a flange in the tip end of the large-diameter portion is produced. When a pin terminal is produced by the production method, as compared with a conventional pin terminal which has the same total length, and in which the length from the tip end to the engagement portion is identical, therefore, the to-be-crimped portion which is formed to have the even outer diameter, and which is capable to being crimped is extended. Even when a shortish inner shaft is employed, therefore, the crimped portion which is actually crimped can be extended because of the to-be-crimped portion which is longer than a conventional one, and the inner shaft and the pin terminal are likely to be firmly coupled together.

In the pin terminal, moreover, reduction of the material can be sufficiently performed correspondingly with the configuration where a flange is not formed in the tip end of the large-diameter portion, and also reduction of the weight can be realized. A glow plug can employ such a pin terminal, and a shortish inner shaft can be employed. Also in a glow plug, therefore, reduction of the material can be sufficiently performed, and also reduction of the weight can be attained.

In the production method, moreover, a flange is not formed in the tip end of the large-diameter portion, and hence it is not necessary to employ a split die which is radially divided in the periphery of the large-diameter portion. According to the production method, therefore, the structure of the die is simplified, the production cost of the die can be lowered, and the durability of the die can be improved.

According to the production method of the invention, it is possible to economically produce a high-quality and light-weight pin terminal for a glow plug, and consequently a high-quality and light-weight glow plug.

In the production method of the invention, in at least one of the step of deforming the end surface, the step of deforming the rear end side and the step of deforming the third workpiece, a fitting recess to which a rear end portion of an inner shaft of the glow plug is fitted is formed in an end surface of the tip end side of the pin terminal. In this case, the steps which are performed until the processing of the fourth workpiece, including molding of the fitting recess are performed by a plastic working. Also during the molding of the fitting recess, therefore, swarf is not produced.

In this regard, in the case where the pin terminal is produced only by applying a cutting process to a workpiece, or where the formation of the fitting recess is produced by a cutting process, swarf is produced. Since there is a possibility that swarf may cause the inner shaft to be hardly fitted to the fitting recess, and that a short circuit may occur, swarf has to be removed away. However, this work for removing the swarf requires great labor. In a pin terminal which is obtained by employing a split die, furthermore, the large-diameter portion is liable to have radial burrs, and the work of surely removing the burrs in order to prevent a situation where the burrs are peeled off to cause a short circuit, from occurring similarly requires great labor. In the production method, by contrast, the amount of swarf can be made minimum, and burrs are hardly produced. Even when labor of removing swarf and burrs is not so much provided, therefore, the assembling property of the glow plug can be improved, and the short circuit caused by the pin terminal can be avoided.

When the steps of processing from the workpiece to the fourth workpiece through the second and third workpieces are performed by a plastic working, moreover, the process time in the process from the first workpiece to the fourth workpiece can be shortened. When the plastic working is performed as described above, for example, a large number of second workpieces can be simultaneously processed to third workpieces, and then to fourth workpieces. Therefore, pin terminals are easily mass produced. Because of these, when a pin terminal is produced as described above, reduction of the production cost thereof can be further realized, and consequently reduction of the production cost of a glow plug can be further realized.

In the production method, as described above, swarf is not produced during the molding of the fitting recess. Since, in the steps of processing from the first workpiece to the fourth workpiece, swarf due to the respective workpieces is not produced, the method can contribute to realization of further resource saving.

In the step of deforming the end surface, a first fitting recess having a first depth may be formed in an end surface on a tip end side of the first workpiece. In the step of deforming the rear end side, a second fitting recess having a second depth which is deeper than the first depth may be formed in an end surface on a tip end side of the second workpiece. In the step of deforming the third workpiece, the fitting recess having a third depth which is deeper than the second depth may be formed in an end surface on a tip end side of the third workpiece.

In this case, in the first to third workpieces, the fitting recess is formed respectively in a plurality of steps so that its depth becomes deeper in the sequence from the first fitting recess to the fitting recess. Therefore, even when the shape of the first fitting recess formed in the first workpiece is deformed in the other subsequent steps, the shape can be corrected when the second fitting recess is formed in the second workpiece.

According to the production method, therefore, the shapes of fitting recesses of produced pin terminals are easily homogenized.

The fitting recess may be configured by a cylindrical inner circumferential surface which extends from a tip end of the large-diameter portion toward a rear end, and an upper bottom surface which is continuous to a rear end of the inner circumferential surface. The upper bottom surface may have a tapered shape in which a diameter becomes smaller toward a rear end side.

According to the inventor's confirmation, because of an affection of plastic deformation of the third workpiece in the formation of the flange, strain or the like easily occurs in the upper bottom surface of the fitting recess, and wrinkles or the like caused by the strain are easily formed in the upper bottom surface. On the other hand, a plating process is applied to a pin terminal of a glow plug for the purpose of protection of the surface thereof. In the case where strain occurs in the upper bottom surface, therefore, a washing solution or the like which is used in the plating process remains in the wrinkles or the like in the upper bottom surface, and therefore the quality of plating in the fitting recess is liable to be lowered. Because of the affection of the remaining washing solution or the like, rust or the like is easily formed on the upper bottom surface. Because of these, the quality of a pin terminal is liable to be lowered.

Therefore, according to one aspect of the present invention, the upper bottom surface of the fitting recess is formed into a tapered shape in which the diameter becomes smaller toward the rear end side, whereby, in the third workpiece in which the fitting recess is formed, the thickness of the circumference of the upper bottom surface is made large. Therefore, the upper bottom surface is hardly (barely) deformed even by plastic deformation in the formation of the flange, and strain or the like hardly occurs in the upper bottom surface. Therefore, a washing solution or the like hardly remains on the upper bottom surface, and plating is satisfactorily applied to the fitting recess. Moreover, also rust or the like is hardly formed on the upper bottom surface. Because of these, the quality of a pin terminal is high.

Furthermore, it is preferable that the upper bottom surface is positioned on a tip end side of the fourth workpiece with respect to the maximum diameter position of the flange. The plastic deformation of the third workpiece in the formation of the flange is largest at the maximum diameter position of the flange. When the upper bottom surface of the fitting recess is positioned on the tip end side of the fourth workpiece with respect to the maximum diameter position of the flange, the influence of the plastic deformation on the upper bottom surface can be further reduced. Therefore, deformation of the upper bottom surface due to plastic deformation hardly occurs, and the pin terminal has a higher quality.

Preferably, the flange has: a first cylindrical surface which is positioned on a side of the small-diameter portion, which is larger in diameter than the small-diameter portion, and which is cylindrical; a convexly curved surface which is connected to the first cylindrical surface, and in which an axial section is arcuate, and a section in a direction perpendicular to an axis is circular; and a second cylindrical surface which is connected to the convexly curved surface, which is equal in diameter to the first cylindrical surface, and which cylindrical. Preferably, the flange has: a first disk surface which is connected to the small-diameter portion, and which extends in the direction perpendicular to the axis; a tapered surface which is connected to the first disk surface, in which a rear end side has a smaller diameter, and which is connected to the first cylindrical surface; and a second disk surface which connects the second cylindrical surface to the large-diameter portion, and which extends in the direction perpendicular to the axis.

In these cases, the convexly curved surface or the tapered surface causes the cap to be easily fitted to the pin terminal. Moreover, the second cylindrical surface causes the cap engaged with the engagement portion to hardly slip off from the pin terminal.

In the production method of the invention, a first die having a first cavity which can mold a rear end side of the convexly curved surface, and a second die having a second cavity which can mold a tip end side of the convexly curved surface may be used. In the first die and the second die, preferably, a parting surface between the first cavity and the second cavity is on a tip end side with respect to the maximum diameter position, and a maximum diameter of the second cavity is smaller than a maximum diameter of the first cavity.

Because of the difference between the maximum diameter of the first cavity and that of the second cavity, in the convexly curved surface formed by the first die and the second die, the side having an arc directed from the parting surface to the first cylindrical surface, and that the side having an arc directed from the parting surface to the second cylindrical surface are different in diameter from each other, with the parting surface as the boundary. Because of the difference between the diameters, in the outer circumferential surface of the convexly curved surface, a step is formed on the tip end side with respect to the maximum diameter position. Therefore, the cap can be engaged with the step. In a pin terminal which is produced by the above-described production method, therefore, the cap can be satisfactorily fitted.

In the case of a pin terminal, in which another engagement portion is disposed on the tip end side of the pin terminal with respect to the step and the cap is to be engaged with the engagement portion, even when the cap is caused to be disengaged from the engagement portion by vibrations or the like, and the cap is moved in the direction along which the cap slips off from the pin terminal, the cap is caused to be engaged with the step. In such a pin terminal, namely, a state is attained where the cap is doubly engaged by the engagement portion and the step, the cap can be further satisfactorily fitted.

In the production method of the invention, the step is formed by using a diameter difference between the maximum diameter of the first cavity and the maximum diameter of the second cavity. Therefore, as compared with the case where a step is formed by a cutting process on the whole outer circumferential surface of the convexly curved surface, for example, production of swarf from the workpiece can be suppressed.

Preferably, the production method of the invention further has an outer diameter finishing step of finishing the outer diameter of the fourth workpiece by performing cutting or polishing in which a cutting depth is 1 mm or less, to form the pin terminal. In this case, the fourth workpiece can be produced in a relatively rough manner, and the production of the fourth workpiece is facilitated. Then, a pin terminal with higher accuracy can be produced by performing cutting or polishing on the fourth workpiece. When the cutting depth is 1 mm or less in this case, cutting swarf or polishing swarf caused by cutting or polishing can be reduced. Therefore, resource saving and reduction of the production cost can be realized without impairing the effects of the invention.

The method of producing a glow plug according to the invention is a method of producing a glow plug including: a cylindrical housing; a heater which is fixed into the housing, and which has a heating portion projecting from a tip end of the housing; a rod-like inner shaft which is placed in the housing, and in which a rear end portion projects from a rear end of the housing; and a pin terminal which is fitted to the rear end portion of the inner shaft, which is used for supplying electricity from an outside to the heating portion through the inner shaft, the method comprising:

obtaining a first workpiece which has a rod-like shape, and which is made of the conductive metal;

plastically deforming an end surface of a rear end side of the first workpiece into a curved surface shape, and setting to a second workpiece;

plastically deforming a rear end side of the second workpiece into a small-diameter portion which is configured to be fitted to a cap for supplying electricity from an outside, and plastically deforming a tip end side of the second workpiece into a large-diameter portion which is larger in diameter than the small-diameter portion to obtain a third workpiece; and plastically deforming the third workpiece to form a flange between the small-diameter portion and the large-diameter portion, the flange being larger in outer diameter than the large-diameter portion, and an engagement portion formed between a position where a diameter of the flange is maximum and the large-diameter portion, an outer diameter of the engagement portion being gradually reduced toward the large-diameter portion, and the engagement portion being configured to be engaged with to obtain a fourth workpiece.

The glow plug which is obtained by the production method of the invention includes a pin terminal including the features of claim 1 above. The glow plug which is obtained by the production method is light weight and economical, and its durability is enhanced because the inner shaft and the pin terminal are fastened to each other with a crimping area which is larger than a conventional one owing to the extended crimped portion. Therefore, its durability is enhanced.

In the glow plug, as compared with a conventional glow plug, a portion of the inner shaft which projects from the rear end of the housing can be shortened, and the whole inner shaft can be shortened. Therefore, reduction of the weight of the glow plug can be realized.

According to the production method of the invention, therefore, a high-quality and light-weight glow plug can be economically produced.

According to the production method of the invention, a high-quality and light-weight pin terminal for a glow plug or glow plug can be economically produced.

BRIEF DESCRIPTION OF THE DRAWINGS

FIG. 2A is a partial cutaway sectional view showing the entire pin terminal, and FIG. 2B is a partial enlarged view showing a convexly curved surface.

DETAILED DESCRIPTION OF PREFERRED EMBODIMENTS

Hereinafter, an embodiment in which the invention is embodied will be described with reference to the drawings.

Figure 1:
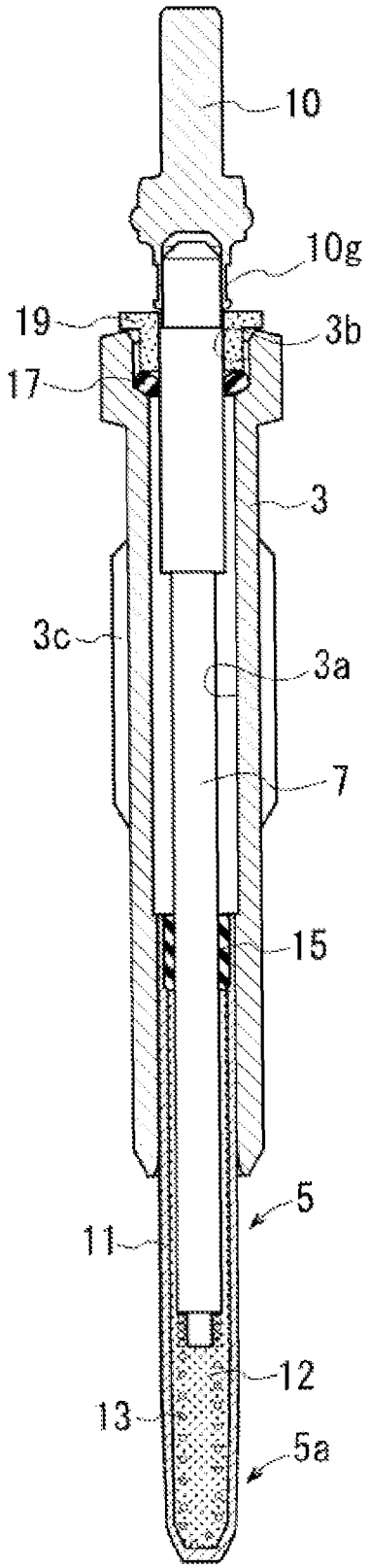
FIG. 1 is a sectional view of a glow plug of an embodiment.

As shown in FIG. 1, a glow plug of the embodiment includes: a metal shell 3 which is a cylindrical housing; a heater 5 which is fixed into the metal shell 3, and which has a heating portion 5*a* projecting from the tip end of the metal shell 3; a rod-like inner shaft 7 which is placed in the metal shell 3, and in which a rear end portion projects from the rear end of the metal shell 3; and a pin terminal 10 which is fitted to the rear end portion of the inner shaft 7, and which is used for supplying electricity from the outside to the heating portion 5*a* through the inner shaft 7.

The heater 5 has a heating tube 11 in which the tip end is closed, which has a tubular shape extending in the axial direction, and which is fixed in an electricity suppliable manner to the interior of the metal shell 3 in a state where a tip end portion of the heater 5 projects from the tip end side of the metal shell 3. The tip end of inner shaft 7 is positioned in the heating tube 11, and the rear end of inner shaft 7 projects from the rear end of the metal shell 3. Insulating powder 12 containing MgO as a major component, and a heating coil 13 are accommodated in the heating tube 11. In the heating coil 13, a tip end portion is joined to the tip end side of the heating tube 11, and a rear end portion is joined to a tip end portion of the inner shaft 7. The heater 5 is configured by the heating tube 11, the insulating powder 12, and the heating coil 13. The tip end side of the heating tube 11 in which the heating coil 13 is accommodated together with the insulating powder 12 is the heating portion 5*a* of the heater 5.

An insulating member 15 in the form of a rubber packing is fixed to a middle portion of the outer circumferential surface of the inner shaft 7. The heating tube 11 is fixed in an insulating state to the inner shaft 7 by crimping the opening end of the heating tube 11 in the periphery of the insulating member 15.

A large-diameter hole 3*b* which has the largest diameter in a shaft hole 3*a* is formed in the rear end side of the metal shell 3. An O-ring 17 and an annular insulator 19 made of an insulating material are placed on a rear-end-directed step between the shaft hole 3*a* and the large-diameter hole 3*b*. The inner shaft 7 is passed through the inner circumferences of the O-ring 17 and the annular insulator 19.

Figure 2A:
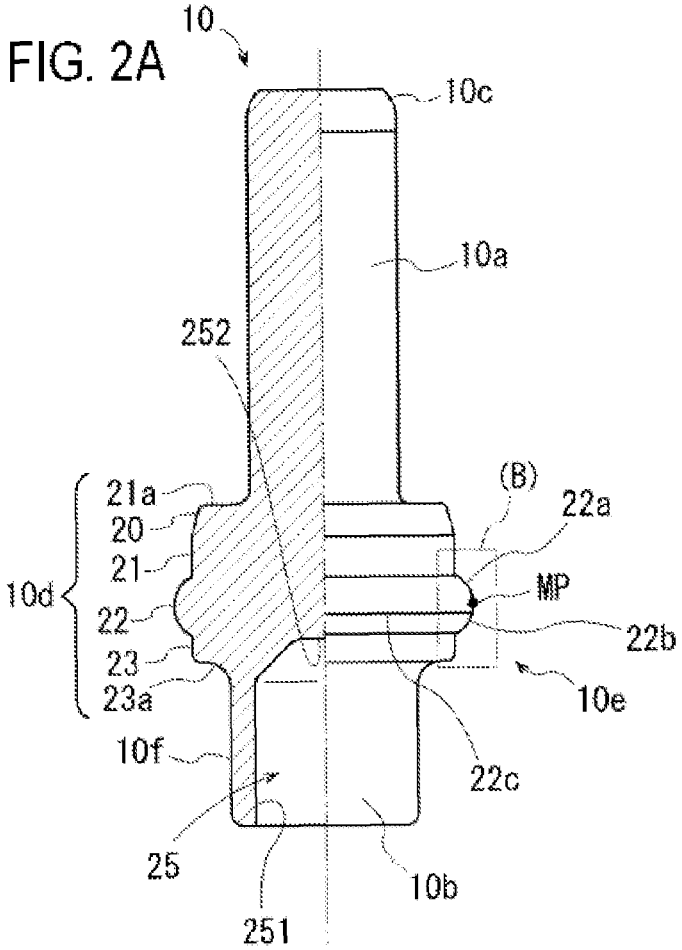
FIGS. 2A and 2B relate to the glow plug of the embodiment, and is a partial cutaway sectional view and partial enlarged view showing a pin terminal which has not been assembled.

As shown in FIG. 2A, the pin terminal 10 has a small-diameter portion 10*a* in the rear end side, and a large-diameter portion 10*b* in the tip end side. The small-diameter portion 10*a* has a shaft-like shape which extends in the axial direction. A curved surface 10*c* is formed on the outer circumference of the end surface of the rear end side of the small-diameter portion 10*a*. A flange 10*d* is formed between the small-diameter portion 10*a* and the large-diameter portion 10*b*. The small-diameter portion 10*a* and the large-diameter portion 10*b* are separated from each other by the flange 10*d*.

The flange 10*d* has a first cylindrical surface 21, a convexly curved surface 22, and a second cylindrical surface 23. The first cylindrical surface 21 is positioned on the side of the small-diameter portion 10*a*, and has a cylindrical shape which is larger in diameter than the small-diameter portion 10*a*. The convexly curved surface 22 is connected to the first cylindrical surface 21, the axial section is arcuate, and a section in a direction perpendicular to the axis is circular. The second cylindrical surface 23 is connected to the convexly curved surface 22, and has a cylindrical shape which is equal in diameter to the first cylindrical surface 21.

The flange 10*d* further has a first disk surface 21*a*, a tapered surface 20, and a second disk surface 23*a*. The first disk surface 21*a* is connected to the small-diameter portion 10*a*, and extends in the direction perpendicular to the axis. The tapered surface 20 is connected in the tip end side to the first cylindrical surface 21, and in the rear end side to the first disk surface 21*a*. The tapered surface 20 is formed so that the rear end side has a smaller diameter. The second disk surface 23*a* connects the second cylindrical surface 23 to the large-diameter portion 10*b*, and extends in the direction perpendicular to the axis. The connecting portion between the second disk surface 23*a* and the large-diameter portion 10*b* has an arcuate shape. Therefore, the second disk surface 23*a* and the large-diameter portion 10*b* are smoothly connected to each other.

Figure 2B:
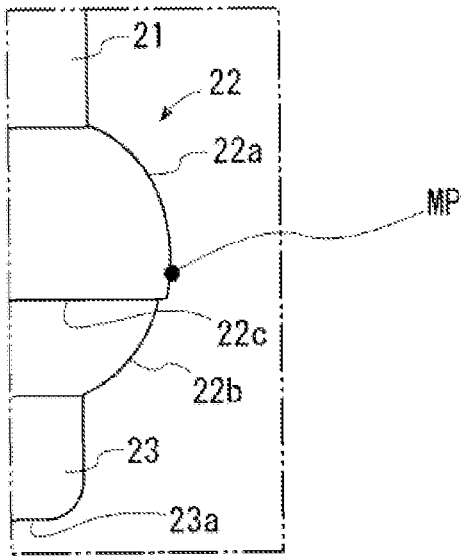

As shown in FIG. 2B, the convexly curved surface 22 is configured, with a place which is slightly on the tip end side with respect to the maximum diameter position MP of the flange 10*d* as the boundary, by: a first arc 22*a* that is directed from the place which is slightly on the tip end side with respect to the maximum diameter position MP, toward the first cylindrical surface 21; and a second arc 22*b* that is directed from the place which is slightly on the tip end side with respect to the maximum diameter position MP, toward the second cylindrical surface 23. In other words, the side having the first arc 22*a* is the rear end side of the convexly curved surface 22, and that the side having the second arc 22*b* is the tip end side of the convexly curved surface 22. A step 22*c* is formed in the boundary between the first arc 22*a* and the second arc 22*b*, namely, in the outer circumferential surface of the convexly curved surface 22 in the place which is slightly on the tip end side with respect to the maximum diameter position MP. The formation of the step 22*c* will be described later in detail.

As shown in FIG. 2A, the large-diameter portion 10*b* is disposed integrally with the tip end of the small-diameter portion 10*a*, and formed so that it is larger in outer diameter than the small-diameter portion 10*a*, and smaller in outer diameter than the flange 10*d*. In the large-diameter portion 10*b*, an engagement portion 10*e* is formed so that the outer diameter is gradually reduced toward the large-diameter portion 10*b*, between the second cylindrical surface 23 of the flange 10*d* and the large-diameter portion 10*b*. The above-described step 22*c* is positioned in the engagement portion 10*e*. In the large-diameter portion 10*b* of the pin terminal 10 before assembly, the outer circumferential surface excluding the engagement portion 10*e*, i.e., the straight portion functions as a to-be-crimped portion 10*f*. The engagement portion 10*e* is requested to be between the maximum diameter position MP of the flange 10*d* and the large-diameter portion 10*b*, and not limited between the second cylindrical surface 23 and the large-diameter portion 10*b*, and may be one portion of the convexly curved surface 22 which is on the tip end side with respect to the maximum diameter position MP, or in the second cylindrical surface 23 or the second disk surface 23*a*.

Furthermore, a fitting recess 25 to which the inner shaft 7 is fitted is formed in the end surface of the tip end side of the large-diameter portion 10*b*. The fitting recess 25 is configured in the pin terminal 10 by an inner circumferential surface 251 which extends from the tip end of the large-diameter portion 10*b* toward the rear end, and an upper bottom surface 252 which is continuous to the rear end of the inner circumferential surface 251, and which is positioned radially inside the flange 10*d*. The upper bottom surface 252 has a tapered shape in which the diameter becomes smaller as advancing from the front end side of the pin terminal 10 toward the rear end side. The upper bottom surface 252 is positioned inside the pin terminal 10, and on the side of the front end with respect to the maximum diameter position MP of the flange 10*d*, more specifically in a place in the pin terminal 10 and corresponding to the second cylindrical surface 23.

Figure 3:
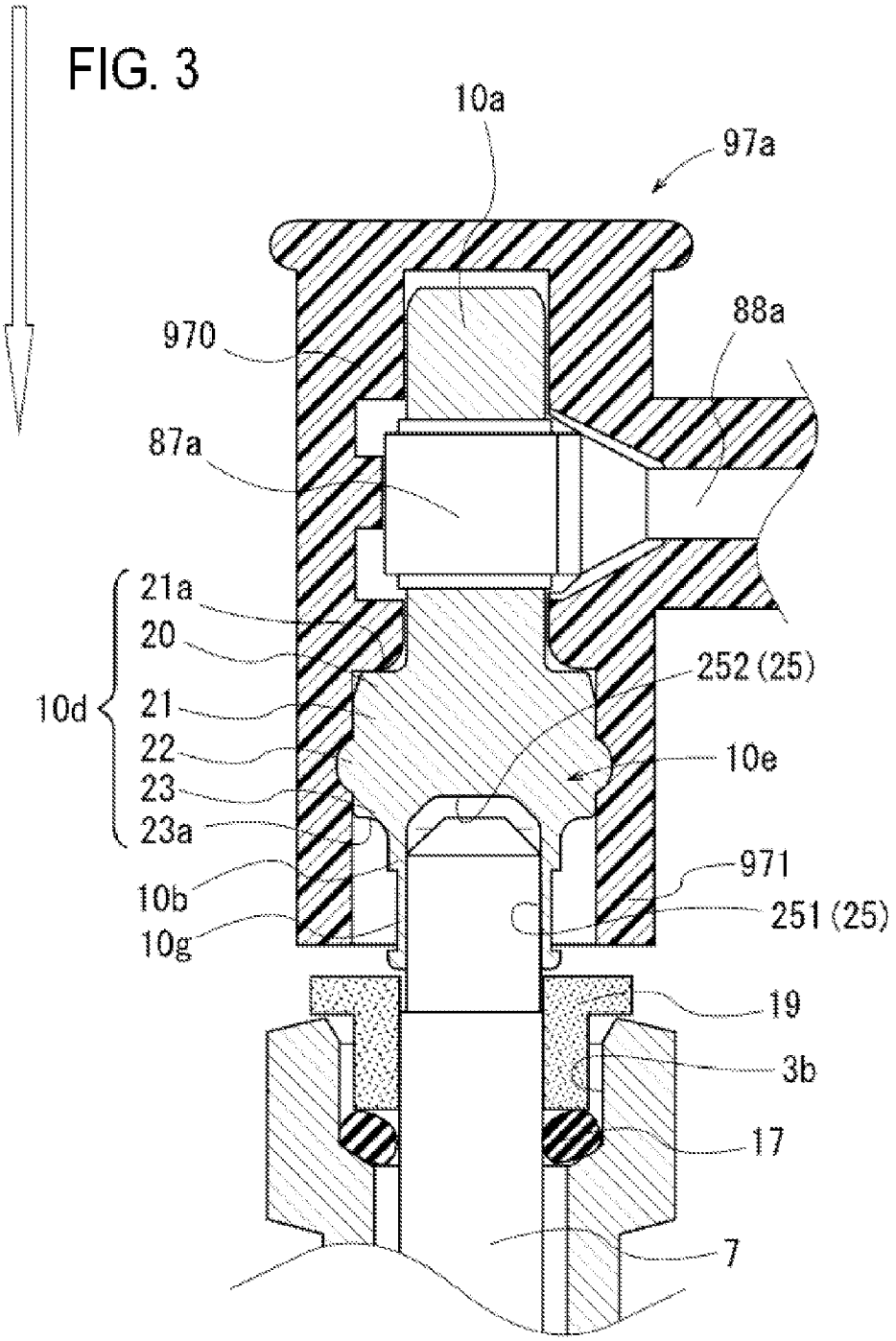
FIG. 3 relates to the glow plug of the embodiment, and is an enlarged sectional view showing a state of fitting of the pin terminal and a cap.

As shown in FIG. 3, a cap 97*a* to which an electric current is to be supplied from the outside is attached to the pin terminal 10. The cap 97*a* has a cup-shaped cap body 970, and an electric conductive member 87*a* which is fixed to the inner side of the cap body 970. The cap body 970 is made of a resin. An engaged portion 971 is formed inside the opening side of the cap body 970. By contrast, the electric conductive member 87*a* is connected to a lead wire 88*a* which leads to a battery that is not shown.

In relation to production of the glow plug, the pin terminal 10 is produced by the following steps.

First Step

Figure 4A:
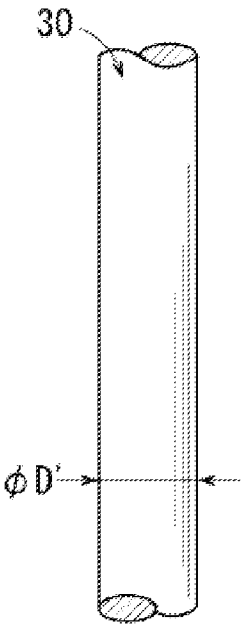
FIGS. 4A to 4E relate a production method of the embodiment, and are side views of a workpiece when each step is ended.
Figure 4B:
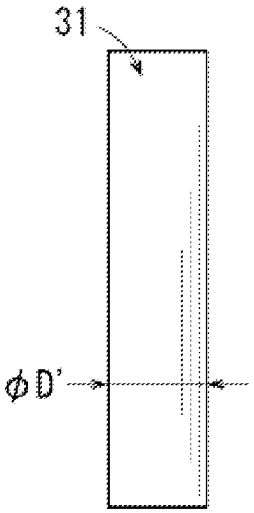

As shown in FIG. 4A, first, a rod member 30 in which ϕD', which has a circular section, and which is made of a steel material that is an electric conductive metal is prepared. The rod member 30 is cut in the axis-perpendicular direction to obtain a first workpiece 31 having a predetermined length, as shown in FIG. 4B.

Second Step

Figure 5:
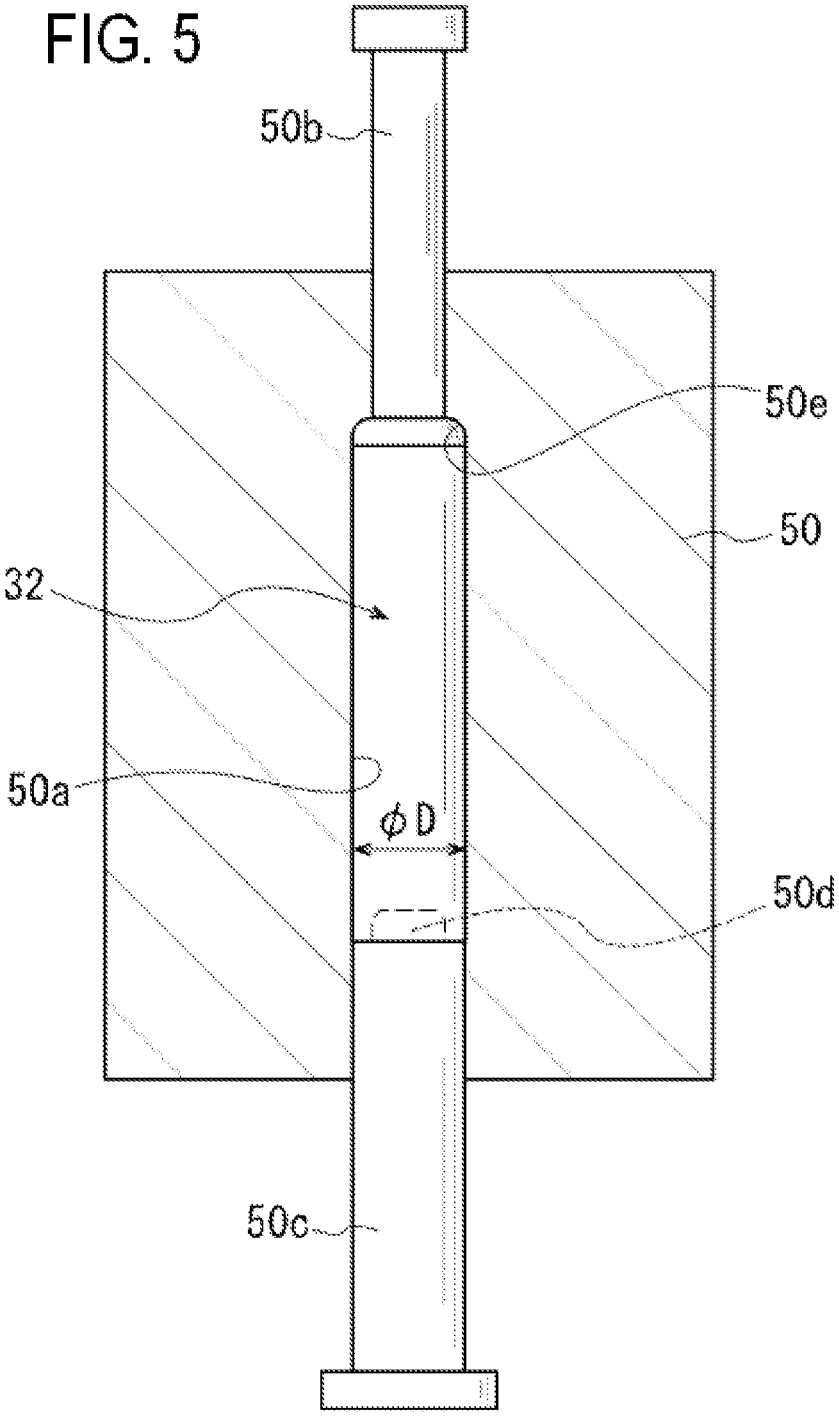
FIG. 5 relates the production method of the embodiment, and is a sectional view showing a second step.

As shown in FIG. 5, an end-surface adjustment die 50 having a cavity 50*a* is prepared. The inner diameter of the cavity 50*a* is ϕD, and slightly larger than ϕD'. The inner diameter ϕD is substantially equal to the outer diameter of the large-diameter portion 10*b* of the pin terminal 10 shown in FIG. 2A.

As shown in FIG. 5, a curved surface 50*e* is formed in the upper end of the cavity 50*a*. A kickout pin 50*b* is disposed in the upper end of the cavity 50*a*, and a punch 50*c* is disposed in the lower end of the cavity 50*a* so as to be pressable in the cavity 50*a*. A convex portion 50*d* having a first height is disposed in the upper end surface of the punch 50*c*. The first height is a height corresponding to a first depth.

Then, the first workpiece 31 is conveyed into the cavity 50*a* of the end-surface adjustment die 50, and the first workpiece 31 is pressed by the punch 50*c*. In the first workpiece 31, therefore, the end surface on the rear end side is pressingly contacted with the kickout pin 50*b* and the curved surface 50*e* to be adjusted, and plastic worked.

Figure 4C:
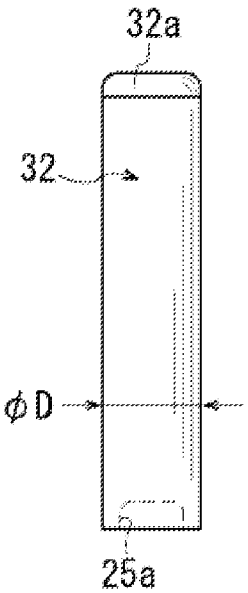

As shown in FIG. 4C, in this way, the first workpiece 31 is formed into a second workpiece 32 which has a curved surface 32*a* in the end surface on the rear end side. Even when, in preparation of the first workpiece 31, covexo-concave portions are formed in the end surface on the rear end side or the end surface is inclined, therefore, the covexo-concave portions are not expanded by an extruding process or the like, and the obtained second workpiece 32 is not unintentionally deformed. In the end surface on the tip end side of the second workpiece 32, a first fitting recess 25*a* having the first depth is formed by the above-described convex portion 50*d*.

Thereafter, the punch 50*c* is lowered, and the second workpiece 32 is taken out from the end-surface adjustment die 50 by the kickout pin 50*b*.

Third Step

Figure 6:
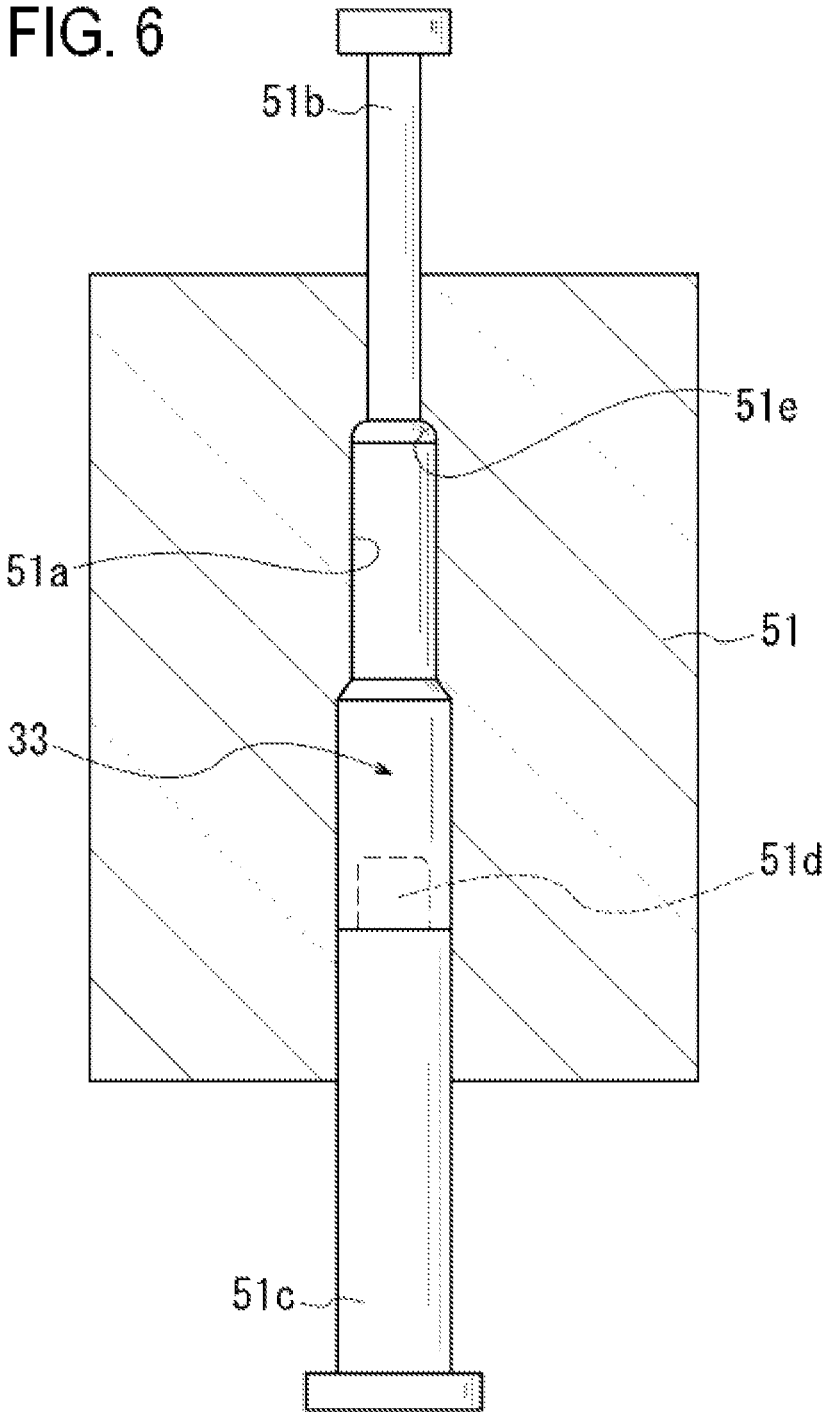
FIG. 6 relates the production method of the embodiment, and is a sectional view showing a third step.

As shown in FIG. 6, then, an extrusion die 51 having a cavity 51*a* in which the upper side has a smaller diameter is prepared.

A curved surface 51*e* is formed in the upper end of the cavity 51*a*. A kickout pin 51*b* is disposed in the upper end of the cavity 51*a*, and a punch 51*c* is disposed in the lower end of the cavity 51*a* so as to be pressable in the cavity 51*a*. A convex portion 51*d* having a second height which is larger than the first height is disposed in the upper end surface of the punch 51*c*. The second height is a height corresponding to a second depth.

Then, the second workpiece 32 is conveyed into the cavity 51*a* of the extrusion die 51 so that the curved surface 32*a* is in the upper side, and the second workpiece 32 is pressed by the punch 51*c*. In the second workpiece 32, therefore, the end surface on the rear end side is again pressingly contacted with the kickout pin 51*b* and the curved surface 51*e* to be adjusted, and plastic worked.

Figure 4D:
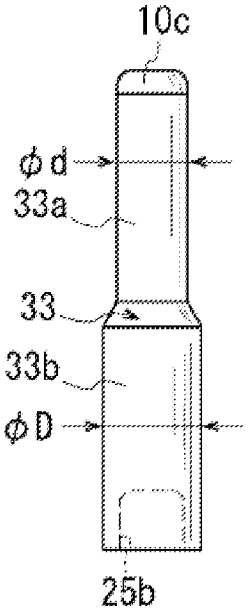

As shown in FIG. 4D, in this way, the second workpiece 32 is formed into a third workpiece 33 in which the rear end side is reduced in diameter. In the third workpiece 33, the rear end side is formed into a small-diameter portion 33*a* of ϕd, and the tip end side is formed into a large-diameter portion 33*b* which remains to have ϕD that is larger than ϕd. The end surface of the small-diameter portion 33*a* is formed into the curved surface 10*c* which is the shape of a product, by causing the curved surface 32*a* to have a smaller diameter. In the end surface of the tip end side of the third workpiece 33, a second fitting recess 25*b* having the second depth which is larger than the first depth is formed by the above-described convex portion 51*d*. Thereafter, the punch 51*c* is lowered, and the third workpiece 33 is taken out from the extrusion die 51 by the kickout pin 51*b*.

Fourth Step

Figure 7:
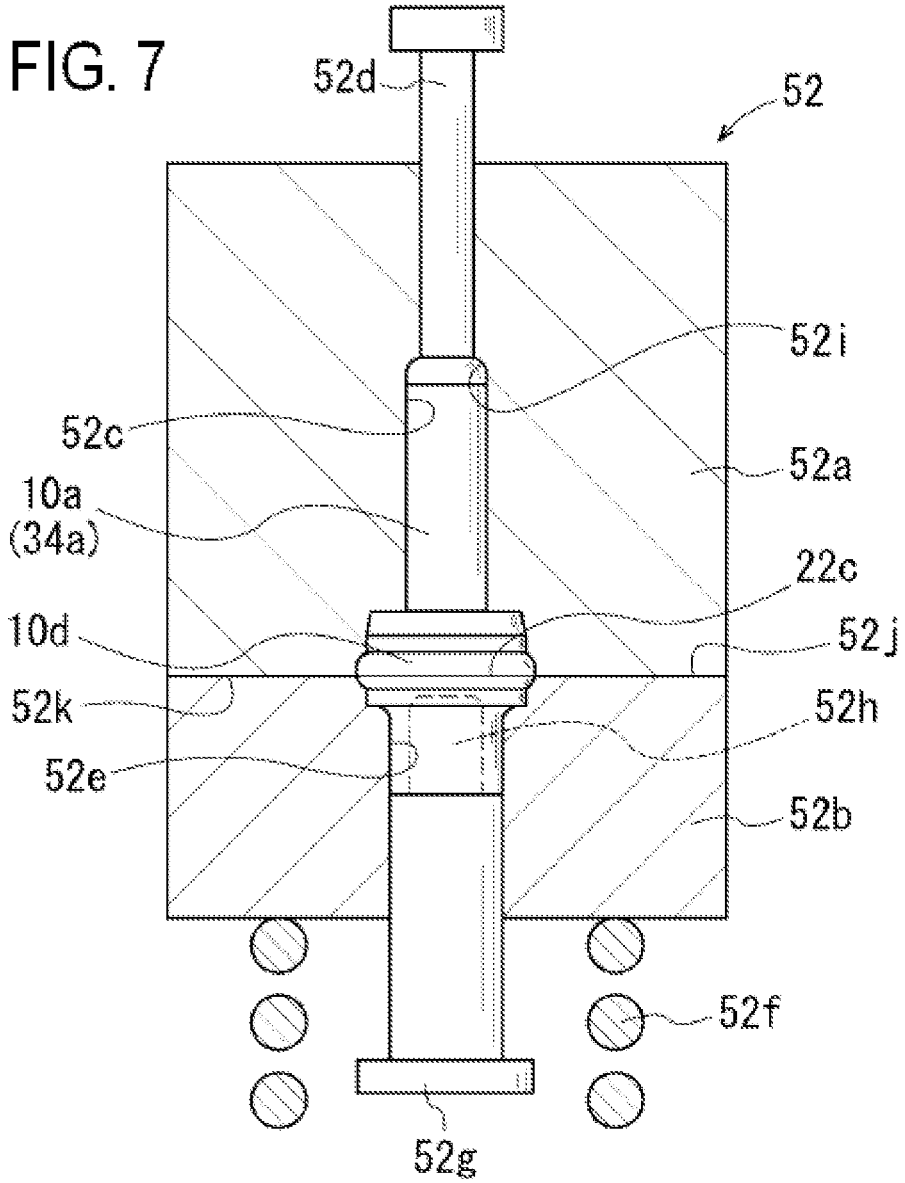
FIG. 7 relates the production method of the embodiment, and is a sectional view showing a fourth step.

In the fourth step, as shown in FIG. 7, a flange molding die 52 including a first die 52*a* and a second die 52*b* is prepared. The second die 52*b* is urged toward the first die 52*a* by a press spring 52*f*.

Figure 8:
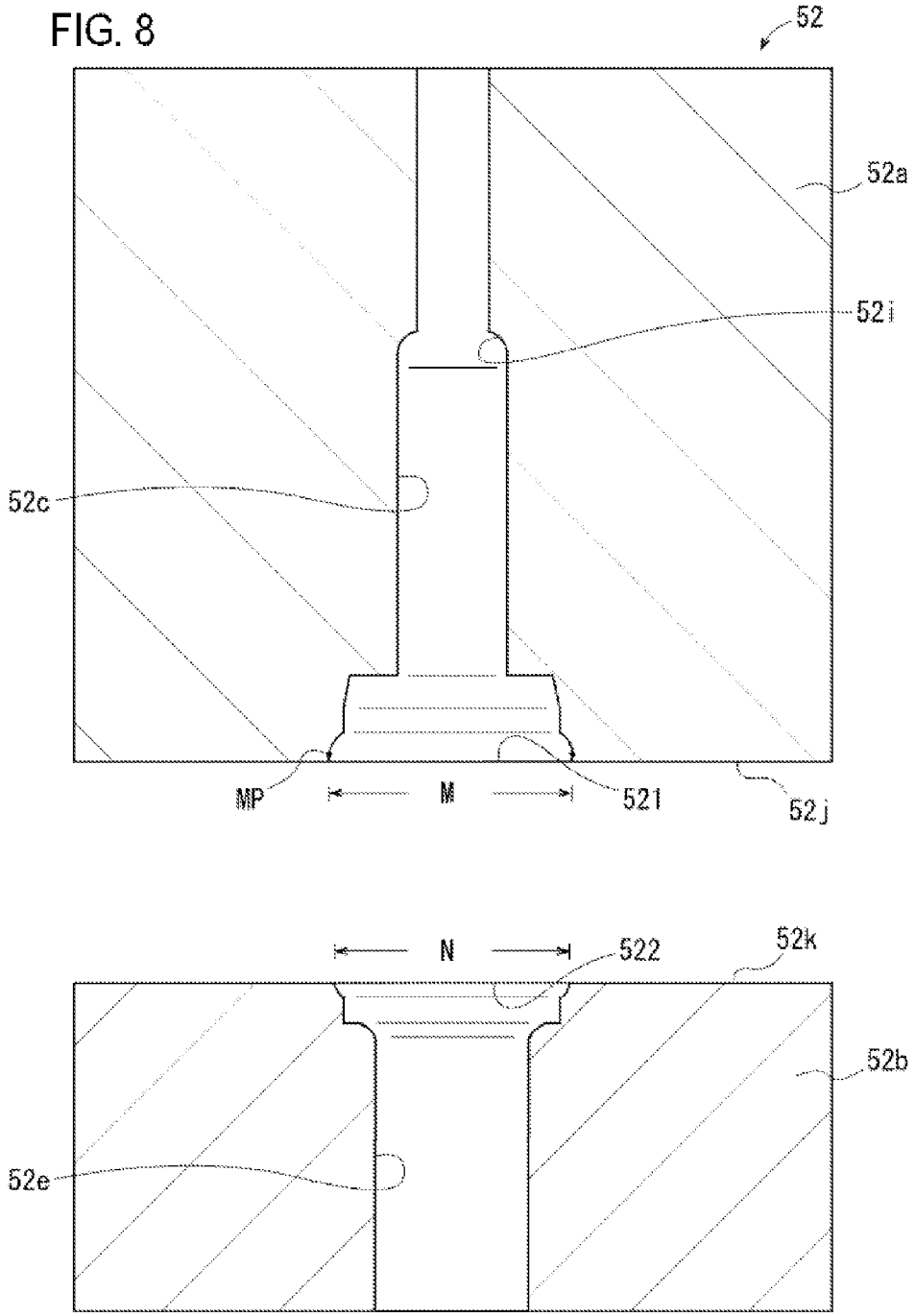
FIG. 8 relates the production method of the embodiment, and is a sectional view showing a first die and a second die.

As shown in FIG. 8, a first cavity 52*c* matching with the small-diameter portion 10*a* shown in FIG. 2A, and the tapered surface 20, first cylindrical surface 21, and first arc 22*a* of the convexly curved surface 22 in the flange 10*d* is formed in the first die 52*a*. Namely, the rear end side starting from the first arc 22*a* of the flange 10*d* can be molded by the first cavity 52*c*. The first cavity 52*c* is formed so that, when the third workpiece 33 shown FIG. 4D is placed, the upper end of the small-diameter portion 33*a* is placed in the first die 52*a*. A curved surface 52*i* is formed in the upper end of the first cavity 52*c*.

On the other hand, a second cavity 52*e* matching with the second cylindrical surface 23 of the flange 10*d* shown in FIG. 2A, the second arc 22*b* in the convexly curved surface 22, and the large-diameter portion 10*b* is formed in the second die 52*b*. Namely, the tip end side starting from the second arc 22*b* of the flange 10*d* can be molded by the second cavity 52*e*.

As described above, in the pin terminal 10, here, the first arc 22*a* and the second arc 22*b* are formed on both sides, respectively, with a place which is slightly on the tip end side with respect to the maximum diameter position MP of the flange 10*d*, as the boundary (see FIG. 2B). In the first die 52*a* and the second die 52*b*, as shown in FIG. 8, namely, die divided surfaces 52*j*, 52*k* for the first cavity 52*c* and the second cavity 52*e* are positioned on the tip end side with respect to the maximum diameter position MP.

A first circular hole 521 matching with the side of the first arc 22*a* is formed in the die divided surface 52*j* in the first die 52*a*. Similarly, a second circular hole 522 matching with the side of the second arc 22*b* is formed in the die divided surface 52*k* in the second die 52*b*. The maximum diameter N of the second circular hole 522 is smaller than the maximum diameter M of the first circular hole 521.

Figure 9:
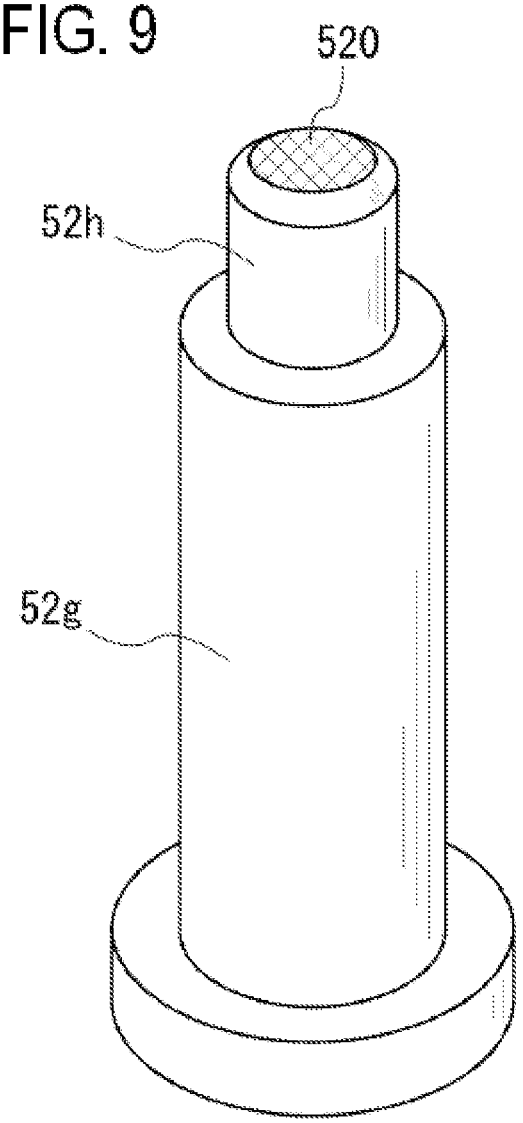
FIG. 9 relates the production method of the embodiment, and is a perspective view showing a punch.

As shown in FIG. 7, a kickout pin 52*d* is disposed in the upper end of the first cavity 52*c*. On the other hand, a punch 52*g* is disposed in the lower end of the second cavity 52*e* so as to be pressable in the second cavity 52*e*. As shown in FIG. 9, a convex portion 52*h* having a third height which is larger than the second height is disposed in the upper end surface of the punch 52*g*. The third height is a height corresponding to a third depth, and more specifically a height from the tip end side of the third workpiece 33 to a position corresponding to the second cylindrical surface 23 of the flange 10*d*. The convex portion 52*h* has a tapered shape in which the diameter is reduced toward its upper end surface 520. A knurling process is performed on the upper end surface 520 of the convex portion 52*h*.

Figure 4E:
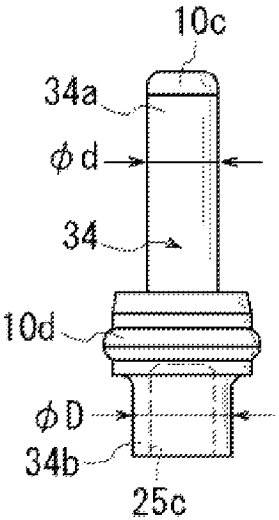

As shown in FIG. 7, the third workpiece 33 is conveyed into the first and second cavities 52*c*, 52*e* of the first die 52*a* and the second die 52*b* so that the small-diameter portion 33*a* is in the upper side, namely on the side of the first die 52*a*, and the third workpiece 33 is pressed by the punch 52*g*. In the third workpiece 33, therefore, the end surface on the rear end side is pressingly contacted with the kickout pin 52*d* and the curved surface 52*i* to be adjusted, and plastically worked. As shown in FIG. 4E, in this way, the third workpiece 33 is formed into a fourth workpiece 34.

In the fourth workpiece 34, the rear end side is a small-diameter portion 34*a* which is identical with the small-diameter portion 33*a* of the third workpiece 33. Moreover, the flange 10*d* is formed between a large-diameter portion 34*b* which is identical with the large-diameter portion 33*b* of the third workpiece 33, and the small-diameter portion 34*a*. At this time, because of the difference between the maximum diameter M of the first circular hole 521 in the first cavity 52*c* and the maximum diameter N of the second circular hole 522 in the second cavity 52*e*, the step 22*c* is formed in the outer circumferential surface which is slightly on the tip end side with respect to the maximum diameter position MP of the flange 10*d*. The step 22*c* has a shape declining toward the tip end side of the convexly curved surface 22 (the tip end side of the fourth workpiece 34). On the other hand, the end surface of the small-diameter portion 34*a* remains to be the curved surface 10*c*. In the end surface of the tip end side of the fourth workpiece 34, a third fitting recess 25*c* having the third depth which is larger than the second depth is formed by the above-described convex portion 52*h*.

Thereafter, the punch 52*g* and the second die 52*b* are lowered, and the fourth workpiece 34 is taken out from the flange molding die 52 by the kickout pin 52*d*. The small-diameter portion 34*a* formed in the fourth workpiece 34 corresponds to the small-diameter portion 10*a* shown in FIG. 2A. Similarly, the large-diameter portion 34*b* formed in the fourth workpiece 34 corresponds to the large-diameter portion 10*b* shown in FIG. 2A, and the third fitting recess 25*c* corresponds to the fitting recess 25 shown in FIG. 2A.

Outer Diameter Finishing Step

Figure 10:
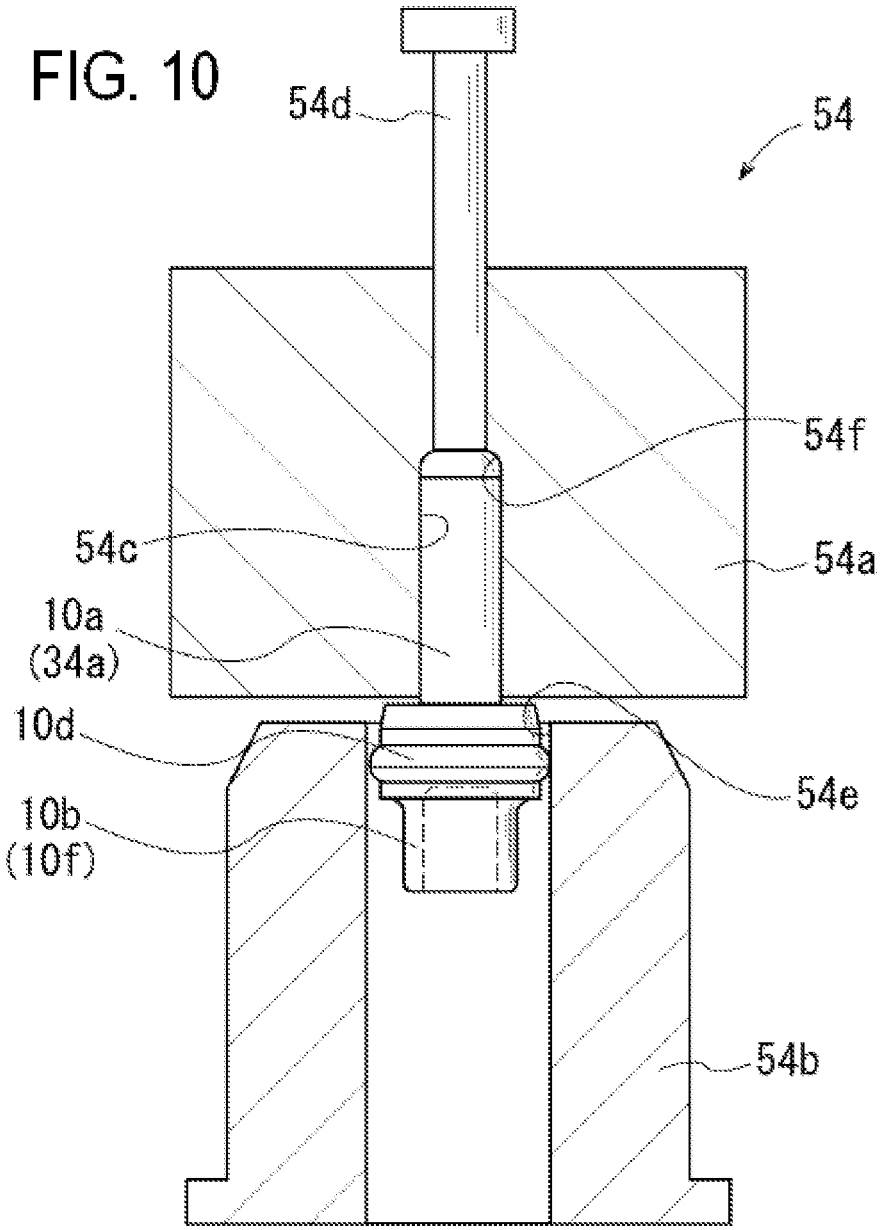
FIG. 10 relates the production method of the embodiment, and is a sectional view showing an outer diameter finishing step.
Figure 11:
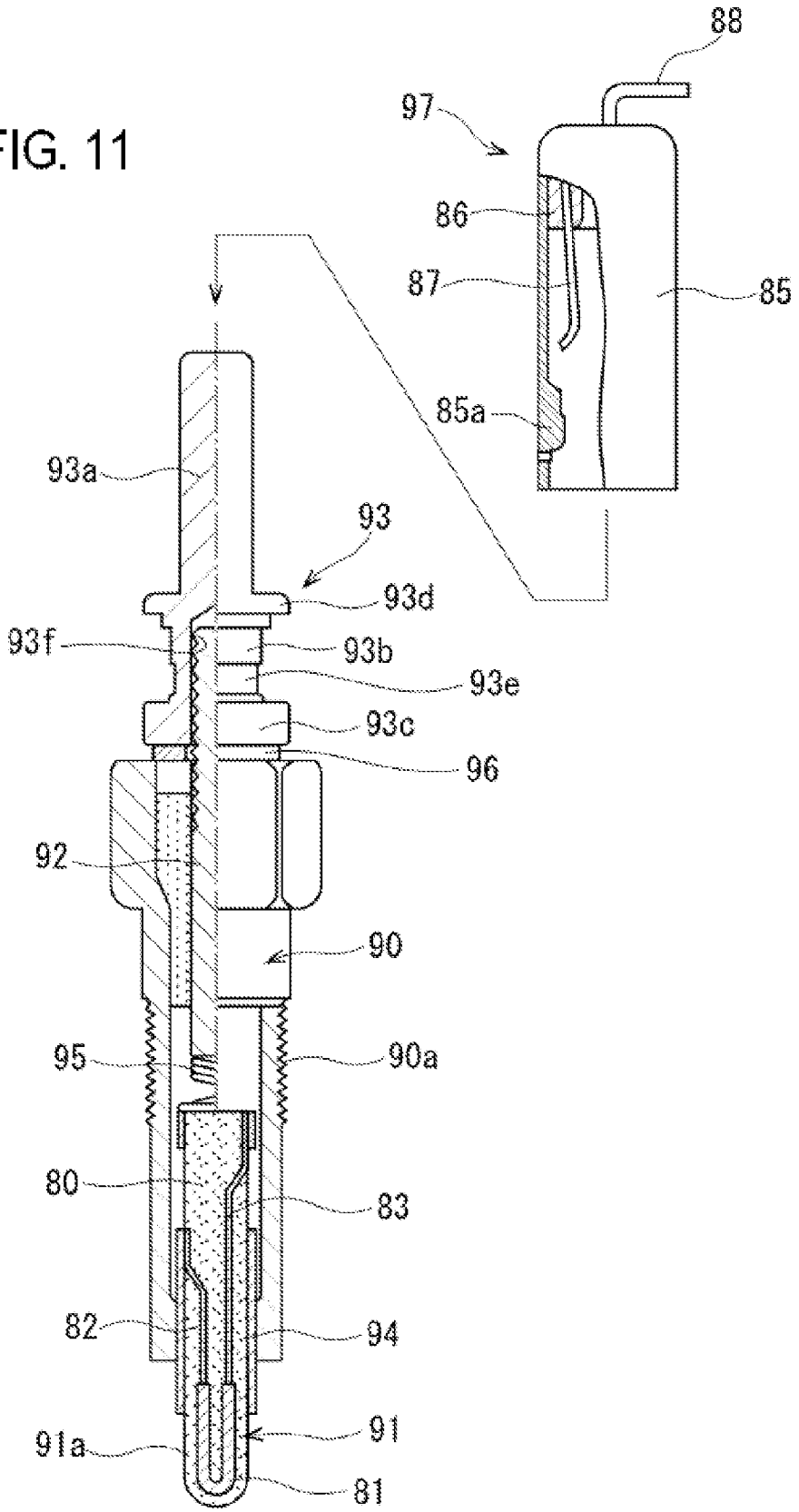
FIG. 11 is a partial cutaway sectional view of a conventional glow plug, etc.

In the outer diameter finishing step, an outer diameter finishing apparatus 54 including a stationary die 54*a* and a cutter 54*b* as shown in FIG. 10 is prepared.

A cavity 54*c* for accommodating the small-diameter portion 34*a* of the fourth workpiece 34 is formed in the stationary die 54*a*. A curved surface 54*f* is formed in the upper end of the cavity 54*c*. A kickout pin 54*d* is disposed in the upper end of the cavity 54*c*. The cutter 54*b* is formed into a cylindrical shape, and disposed so as to be vertically movable. The cutter 54*b* has a blade portion 54*e* in the outer circumference of the tip end, so that the outer circumferential side of the flange 10*d* of the fourth workpiece 34 is cut by the blade portion 54*e*.

Then, the fourth workpiece 34 is conveyed into the cavity 54*c* of the stationary die 54*a* so that the small-diameter portion 34*a* is in the upper side, and the cutter 54*b* cuts away the outer circumferential side of the flange 10*d* of the fourth workpiece 34. At this time, the cutting degree with respect to the outer circumferential side of the flange 10*d* is ϕ1 mm or less. Therefore, the outer diameter of the flange 10*d* can be made constant, and its roundness can be enhanced. After the cutting process on the outer circumferential side of the flange 10*d* of the fourth workpiece 34 is ended, the fourth workpiece 34 is taken out from the stationary die 54*a* by the kickout pin 52*d*. Finally, a plating process is applied to the fourth workpiece 34 by a known method. In this way, the pin terminal 10 shown in FIG. 2A is obtained.

On the other hand, as shown in FIG. 1, the metal shell 3, the heating tube 11, the insulating member 15, the heating coil 13, the inner shaft 7, the O-ring 17, the insulator 19, and the like are prepared. While electrically connecting required places of these components to one another, these components and the pin terminal 10 are assembled together by a known method. In this case, in the rear end side of the insulator 19, the to-be-crimped portion 10*f* (see FIG. 2A) of the pin terminal 10 is actually crimped in a state where the rear end portion of the inner shaft 7 is fitted to the fitting recess 25. As shown in FIG. 1, therefore, the inner shaft 7 and the pin terminal 10 are joined together. Furthermore, a crimped portion 10*g* is formed on the outer circumferential surface of the large-diameter portion 10*b*. In this way, the glow plug is completed.

In the thus obtained glow plug, the heating portion 5*a* of the heater 5 is located in a combustion chamber of a diesel engine by screwing a male thread 3*c* of the metal shell 3 to a cylinder head of the diesel engine. Then, the metal shell 3 is grounded to the cylinder head, and the cap 97*a* shown in FIG. 3 is fitted to the pin terminal 10.

When the cap 97*a* is pressingly put on the pin terminal 10 from the direction of the arrow shown in the figure, a state is attained where the engaged portion 971 is engaged with the engagement portion 10*e* and the cap 97*a* is fitted to the pin terminal 10. In this state, the electric conductive member 87*a* is connected to the small-diameter portion 10*a*, thereby allowing electricity to be supplied to the pin terminal 10 through the electric conductive member 87*a*, and consequently to the glow plug.

Therefore, a voltage is applied between the metal shell 3, and the pin terminal 10 and the inner shaft 7, and the heating portion 5*a* in the heater 5 is heated by the heating coil 13. Therefore, starting of the diesel engine is initiated.

In the method of producing a glow plug of the embodiment, when the pin terminal 10 is to be produced, as described above, the fourth workpiece which has the flange 10*d* between the small-diameter portion 10*a* and the large-diameter portion 10*b*, and in which a flange is not formed in the tip end of the large-diameter portion 10*b* is produced. In the pin terminal 10 which is obtained by the production method, as compared with a conventional pin terminal which has the same total length, and in which the length from the tip end to the engagement portion 10*e* is identical, therefore, the to-be-crimped portion 10*f* (the above-described straight portion) which is formed to have the even outer diameter, and which is capable of being crimped is extended. In a glow plug which is obtained by the production method, therefore, the shortish inner shaft 7 can be employed as compared with a conventional glow plug. Even in such a case, the crimped portion 10*g* which is actually crimped is extended because of the to-be-crimped portion 10*f* which is longer than a conventional one, and the inner shaft 7 and the pin terminal 10 are easily firmly coupled together. Moreover, the extended crimped portion 10*g* enables the inner shaft 7 and the pin terminal 10 to be fastened to each other with a crimping area which is larger than a conventional one. Therefore, the durability of the glow plug is enhanced.

In the pin terminal 10 disposed in the glow plug, the material can be sufficiently reduced by an amount corresponding to the non-formation of a flange in the tip end of the large-diameter portion 10*b*, and also reduction of the weight is attained. Since the shortish inner shaft 7 can be employed as described above, reduction of the material can be sufficiently performed, and also reduction of the weight can be attained.

In the pin terminal 10 which is obtained by the production method, a flange is not formed in the tip end of the large-diameter portion 10*b*, and hence it is not necessary to employ a split die which is radially divided in the periphery of the large-diameter portion 10*b*, in the production of the pin terminal 10. According to the production method, therefore, the structure of the die is simplified, the production cost of the die can be lowered, and the durability of the die can be improved.

According to the production method of the embodiment, therefore, it is possible to economically produce the high-quality and light-weight pin terminal 10 for a glow plug, and consequently a high-quality and light-weight glow plug.

In the production method for the pin terminal 10, particularly, all the steps of processing the workpiece 30 made of a conductive metal from the first workpiece 31 to the fourth workpiece 34, including the formation of the fitting recess 25 are performed by a plastic working. In the production method, in the production of the pin terminal 10, therefore, swarf is not produced in the first to fourth workpieces 31 to 34. In the production method, therefore, the amount of swarf in the production of the pin terminal 10 can be made minimum. Furthermore, a split die is not used as described above, and hence burrs are hardly produced in the first to fourth workpieces 31 to 34. Because of these, even when countermeasures for removing swarf and burrs are not so taken in the pin terminal 10, the assemblability of the glow plug is improved, and it is possible to avoid occurrence of a short circuit caused by the pin terminal 10.

When the process steps from the first workpiece to the fourth workpiece through the second and third workpieces are performed by a plastic working as described above, also the process time in the process from the first workpiece 31 to the fourth workpiece 34 can be shortened. When a plastic working is performed as described above, it is possible that many second workpieces 32 can be simultaneously processed to respective third workpieces 33 and consequently fourth workpieces 34. Therefore, pin terminals 10 are easily mass produced. Because of these, when the pin terminal 10 is produced as described above, reduction of the production cost thereof can be further realized, and consequently reduction of the production cost of a glow plug can be further realized.

In this case, in the steps of processing from the first workpiece 31 to the fourth workpiece 34, swarf due to the respective workpieces 32 to 34 is not produced, and hence the method can contribute to realization of further resource saving.

In the production method, when the pin terminal 10 is to be produced, the first fitting recess 25*a* having the first depth is formed in the end surface on the tip end side of the first workpiece 31 in the second step. The second fitting recess 25*b* having the second depth which is deeper than the first depth is formed in the end surface on the tip end side of the second workpiece 32 in the third step. In the fourth step, then, the fitting recess 25 (the third fitting recess 25*c*) having the third depth which is deeper than the second depth is formed in the end surface on the tip end side of the third workpiece 33.

In the production method, as described above, the fitting recess 25 is formed in the second to fourth workpieces 32 to 34 in the plurality of steps so that its depth becomes deeper in the sequence from the first fitting recess 25*a* to the fitting recess 25 (the third fitting recess 25*c*). In the production method, therefore, even when the shape of the first fitting recess 25*a* formed in the first workpiece 31 is changed in the other subsequent steps, for example, the shape can be corrected when the second fitting recess 25*b* is formed in the second workpiece 32. According to the production method, therefore, the shapes of the fitting recesses 25 of produced pin terminals 10 are easily homogenized. The qualities of glow plugs are easily homogenized.

When the molding of the fitting recess 25 is divided into the plurality of steps as described above, the convex portions 50*d*, 51*d*, 52*h* which are disposed respectively in the punches 50*c*, 51*c*, 52*g* can have the first to third heights corresponding to the first to third depths, respectively. In the respective pressings of the second to fourth workpieces 32 to 34 by the punches 50*c*, 51*c*, 52*g*, therefore, the burdens on the convex portions 50*d*, 51*d*, 52*h* can be reduced. Therefore, the durabilities of the punches 50*c*, 51*c*, 52*g* can be enhanced.

As shown in FIG. 2A, here, the fitting recess 25 in the pin terminal 10 is configured by the cylindrical inner circumferential surface 251 which extends from the tip end of the large-diameter portion 10*b* toward the rear end, and the upper bottom surface 252 which is continuous to the rear end of the inner circumferential surface 251. As shown in FIG. 9, the convex portion 52*h* of the punch 52*g* has the tapered shape in which the diameter becomes smaller toward the upper end surface 520. Therefore, the upper bottom surface 252 of the formed fitting recess 25 has the tapered shape in which the diameter becomes smaller toward the rear end side of the pin terminal 10. The fitting recess 25 has the third depth. Therefore, the upper bottom surface 252 is positioned in the place in the pin terminal 10 and corresponding to the second cylindrical surface 23.

In the fourth step for obtaining the pin terminal 10, in the third workpiece 33 in which the third fitting recess 25*c* is formed, namely, the thickness of the circumference of the upper bottom surface 252 is made large. Therefore, the upper bottom surface (corresponding to the upper bottom surface 252 of the fitting recess 25) of the third fitting recess 25*c* is hardly deformed even by plastic deformation in the formation of the flange 10*d*, and strain or the like hardly occurs in the upper bottom surface 252. Although the plastic deformation of the third workpiece 33 is largest at the maximum diameter position MP of the flange 10*d*, the upper bottom surface 252 is positioned at the place which is on the tip end side with respect to the maximum diameter position MP of the flange 10*d*, and, in the obtained fourth workpiece 34, deformation of the upper bottom surface 252 due to plastic deformation therefore hardly occurs. In the fourth workpiece 34, because of these, strain or wrinkles or the like caused by the strain hardly occur in the upper bottom surface 252, and a washing solution or the like which is used in the plating process hardly remains in the upper bottom surface 252. In the pin terminal 10, therefore, a state where plating is satisfactorily applied to the fitting recess 25 is attained. In the pin terminal 10, moreover, also rust or the like is hardly formed on the upper bottom surface 252.

Furthermore, a knurling process is performed on the upper end surface 520 of the convex portion 52*h* of the punch 52*g*. During the pressurization on the third workpiece 33 by the punch 52*g*, therefore, the convex portion 52*h* hardly slips in the second fitting recess 25*b*, and the third fitting recess 25*c* can be satisfactorily formed. Because of these, the quality of the pin terminal 10 is high.

The flange 10*d* has the first cylindrical surface 21, the convexly curved surface 22, and the second cylindrical surface 23. The flange 10*d* further has the first disk surface 21*a*, the tapered surface 20 which is connected to the first disk surface 21*a* and the first cylindrical surface 21, and the second disk surface 23*a* which connects the second cylindrical surface 23 to the large-diameter portion 10*b*. In the outer circumferential surface of the convexly curved surface 22 of the flange 10*d*, moreover, the step 22*c* is formed in the place which is slightly on the tip end side with respect to the maximum diameter position MP.

Because of these, the cap 97*a* is easily fitted to the pin terminal 10, and the cap 97*a* engaged with the engagement portion 10*e* hardly slips off from the pin terminal 10. Specifically, the cap 97*a* is attached to the pin terminal 10 while the cap 97*a* is pressed in the direction of the arrow shown in FIG. 3, whereby the engaged portion 971 of the cap body 970 is elastically deformed so as to expand along the first disk surface 21*a* and the tapered surface 20, and reaches the convexly curved surface 22. Then, the engaged portion 971 is elastically deformed so as to further expand along the first arc 22*a*, and reaches the maximum diameter position MP. After passing through the maximum diameter position MP, the engaged portion 971 moves along the step 22*c* and the second arc 22*b*, so that, while elastically deformed so as to be narrowed, the engaged portion reaches the engagement portion 10*e* through the second cylindrical surface 23. Then, the engaged portion 971 is engaged with the engagement portion 10*e*. In this way, the direction of attaching the cap 97*a* to the pin terminal 10, and the tapered surface 20 and the first arc 22*a* extend along each. Therefore, the cap 97*a* can be easily fitted to the pin terminal 10.

On the other hand, even when the engaged portion 971 is disengaged from the engagement portion by vibrations of the diesel engine or the like, and the cap 97*a* is moved in the direction along which it slips off from the pin terminal 10, i.e., the direction opposite to the arrow in the figure, the engaged portion 971 is caught by the above-described step 22*c*, and caused in situ to be engaged with the step 22*c*. Even when the engaged portion 971 is elastically expandingly deformed by the movement along the second arc 22*b*, namely, the engaged portion 971 abuts against the step 22*c* to be disabled to expand larger than the second arc 22*b*, and cannot override the step 22*c* to reach toward the first arc 22*a*. As a result, the engaged portion 971 is engaged with the step 22*c* as described above. In the pin terminal 10, as described above, the state where the cap 97*a* is doubly engaged with the engagement portion 10*e* and the step 22*c* is attained, and hence the cap 97*a* can be fitted to the pin terminal 10 more satisfactorily.

In the fourth step, moreover, the step 22*c* is formed by using the diameter difference between the maximum diameter M of the first circular hole 521 in the first cavity 52*c* and the maximum diameter N of the second circular hole 522 in the second cavity 52*e*. Therefore, as compared with the case where the step 22*c* is formed by performing a cutting process on the whole outer circumferential surface of the convexly curved surface 22, for example, production of swarf from the fourth workpiece 34 can be suppressed.

In the production method, when the pin terminal 10 is to be produced, the outer diameter finishing step of finishing the outer diameter of the fourth workpiece by cutting with 1 mm or less in depth to form the pin terminal 10 is performed. Therefore, the fourth workpiece 34 can be produced in a relatively rough manner, so that the production of the fourth workpiece 34 is facilitated. The pin terminal 10 with higher accuracy can be produced by performing cutting on the fourth workpiece 34. In this case, when the cutting depth is 1 mm or less, the amount of swarf caused by cutting can be reduced. Therefore, resource saving and reduction of the production cost can be realized without impairing the effects of the invention.

Although in the above the invention has been described with reference to the embodiment, the invention is not limited to the above-described embodiment. It is a matter of course that the invention can be applied while being adequately modified without departing from the spirit of the invention.

In the glow plug, for example, a housing made of a resin may be employed in place of the metal shell 3.

In the embodiment, the heating tube 11, the insulating powder 12, and the heating coil 13 constitute the heater 5. However, a ceramic heater may be used as the heater.

In the outer diameter finishing step, the pin terminal 10 may be finished by polishing in place of cutting. Also in this case, the polishing extent in polishing with respect to the outer circumferential side of the flange 10*d* is set to ϕ1 mm or less. Similarly with the case of cutting, therefore, the amount of swarf caused by polishing can be reduced. In the outer diameter finishing step, a portion of the fourth workpiece 34 other than the outer circumferential side of the flange 10*d* may be cut or polished.

The punches 50*c*, 51*c* may have the same configuration as the punch 52*g* except the lengths of the convex portions 50*d*, 51*d*. In this case, even in the case where the first fitting recess 25*a* or the second fitting recess 25*b* is to be formed, the convex portions 50*d*, 51*d* are caused to hardly slide with respect to the first and second workpieces 31, 32 by the knurling process performed on the upper end surfaces of the convex portions 50*d*, 51*d*, and the first fitting recess 25*a* or the second fitting recess 25*b* can be satisfactorily formed.

DESCRIPTION OF REFERENCE NUMERALS AND SIGNS

3 . . . metal shell (housing)
5*a* . . . heating portion
5 . . . heater
7 . . . inner shaft
10 . . . pin terminal
31 . . . first workpiece
32 . . . second workpiece
97 . . . cap
10*a*, 33*a*, 34*a* . . . small-diameter portion
10*b*, 33*b*, 34*b* . . . large-diameter portion
33 . . . third workpiece
10*d* . . . flange
MP . . . maximum diameter position
10*e* . . . engagement portion
34 . . . fourth workpiece
25, 25*a* to 25*c* . . . fitting recess (25*a* . . . first fitting recess, 25*b* . . . second fitting recess, 25*c* . . . third fitting recess)
21 . . . first cylindrical surface
22 . . . convexly curved surface
23 . . . second cylindrical surface
21*a* . . . first disk surface
20 . . . tapered surface
23*a* . . . second disk surface
52*c* . . . first cavity
52*a* . . . first die
52*e* . . . second cavity
52*b* . . . second die

The invention claimed is:

1. A method of producing a pin terminal for a glow plug the method comprising:

providing a workpiece which has a rod-like shape and which is made of a conductive metal, said workpiece having a first end and a second end, and;

plastically deforming an end surface of a first end of the workpiece into a curved surface shape;

plastically deforming said first end of the workpiece into a small-diameter portion, and plastically deforming a second end of the workpiece into a large-diameter portion which is larger in diameter than the small-diameter portion to; and plastically deforming a flange between the small-diameter portion and the large-diameter portion and plastically deforming an engagement portion between the flange and the large-diameter portion, an outer diameter of the engagement portion being gradually reduced toward the large-diameter portion, wherein, said large-diameter portion is dimensioned to connect to an end portion of an inner shaft of a glow plug, and said small-diameter portion is dimensioned to be received within a cap for electrically connecting said pin terminal to an external electrical source, said cap in engagement with terminal pin between said large-diameter portion and where said flange has a maximum diameter.

2. The method according to claim 1, wherein, a fitting recess to which said end portion of said inner shaft of the glow plug is fitted is formed in an end surface of the second end of the pin terminal.

3. The method according to claim 2, wherein, in the step of deforming the end surface, a first fitting recess having a first depth is formed in said end surface on said second end of the workpiece, in the step of deforming the first end, a second fitting recess having a second depth which is deeper than the first depth is formed in an end surface on the second end of the workpiece, and, the fitting recess having a third depth which is deeper than the second depth is formed in an end surface on said second end of the workpiece.

4. The method according to claim 2 or 3, wherein the fitting recess is configured by a cylindrical inner circumferential surface which extends from an end of the large-diameter portion toward said first end, and an upper bottom surface which is continuous to a rear end of the inner circumferential surface, and the upper bottom surface has a tapered shape in which a diameter becomes smaller toward the first end of said pin.

5. The method according to claim 4, wherein the upper bottom surface is positioned on said second end of the workpiece with respect to the maximum diameter position of the flange.

6. The method according to claim 1, wherein the flange has:

a first cylindrical surface which is positioned to one side of the small-diameter portion and which is larger in diameter than the small-diameter portion;

a convexly curved surface which is connected to the first cylindrical surface, and in which an axial section is arcuate, and a section in a direction perpendicular to an axis is circular; and a second cylindrical surface which is connected to the convexly curved surface, which is equal in diameter to the first cylindrical surface.

7. The method according to claim 6, wherein the flange has:

a first disk surface which is connected to the small-diameter portion, and which extends in the direction perpendicular to the axis;

a tapered surface which is connected to the first disk surface, in which first end has a smaller diameter, and which is connected to the first cylindrical surface; and a second disk surface which connects the second cylindrical surface to the large-diameter portion, and which extends in the direction perpendicular to the axis.

8. The method according to claim 5, wherein a first die having a first cavity which can mold a first end of the convexly curved surface, and a second die having a second cavity which can mold a disposed toward the second end of the convexly curved surface are used, and, in the first die and the second die, a parting surface between the first cavity and the second cavity is on a second end of the pin terminal with respect to the maximum diameter position, and a maximum diameter of the second cavity is smaller than a maximum diameter of the first cavity.

9. The method according to claim 1, further comprising the steps of finishing the workpiece by performing cutting or polishing the outer diameter of the workpiece by 1 mm or less, to form the pin terminal.

10. A method of producing a glow plug including: a cylindrical housing; a heater which is fixed into the housing, and which has a heating portion projecting from a second end of the housing; a rod-like inner shaft which is placed in the housing, and in which an end projects from a first end of the housing; and a pin terminal which is fitted to the first end of the inner shaft, which is used for supplying electricity from an outside to the heating portion through the inner shaft, the method comprising:

providing a workpiece which has a rod-like shape and which is made of a conductive metal, said workpiece having a first end and second end;

plastically deforming said first end of the workpiece into a curved surface shape;

plastically deforming said first end of the workpiece into a small-diameter portion which is configured to be fitted to a cap for supplying electricity from an outside, and plastically deforming a second end of the workpiece into a large-diameter portion which is larger in diameter than the small-diameter portion; and plastically deforming the workpiece to form a flange between the small-diameter portion and the large-diameter portion, the flange being larger in outer diameter than the large-diameter portion, and plastically deforming an engagement portion between the flange and the large-diameter portion, an outer diameter of the engagement portion being gradually reduced toward the large-diameter portion, wherein, said large-diameter portion is dimensioned to connect to an end portion of an inner shaft of a glow plug, and said small-diameter portion is dimensioned to be received within a cap for electrically connecting said pin terminal to an external electrical source, said cap in engagement with terminal pin between said large-diameter portion and where said flange has a maximum diameter.

* * * * *